United States Patent [19]

Wilkin

[11] 4,136,867

[45] Jan. 30, 1979

[54] VIBRATING EXERCISING WHEEL

[76] Inventor: Douglas G. Wilkin, 3061 Evelyn St., La Crescenta, Calif. 91214

[21] Appl. No.: 802,178

[22] Filed: May 31, 1977

[51] Int. Cl.[2] ..... A63B 21/00

[52] U.S. Cl. ..... 272/127; 128/57

[58] Field of Search ..... 272/128, 127, 143; 46/111, 112, 201; 128/57

[56] References Cited

U.S. PATENT DOCUMENTS

| | | | |
|---|---|---|---|
| 1,882,490 | 10/1932 | Falck | 128/57 |
| 3,403,906 | 10/1968 | Burzenski | 272/127 X |
| 3,664,334 | 5/1972 | O'Neil | 128/57 |
| 3,752,475 | 8/1973 | Ott | 272/127 X |
| 3,970,078 | 7/1976 | Rogers | 128/57 |

*Primary Examiner*—Richard C. Pinkham
*Assistant Examiner*—William R. Browne
*Attorney, Agent, or Firm*—Flam & Flam

[57] ABSTRACT

An exercise wheel has a noncircular periphery preferably formed by a series of equiangularly spaced teeth. Handles are mounted on ends of an axle projecting through the wheel. As the wheel is moved along the floor, vibrations are imparted to the user through the axle and handles.

7 Claims, 7 Drawing Figures

FIG. 1.
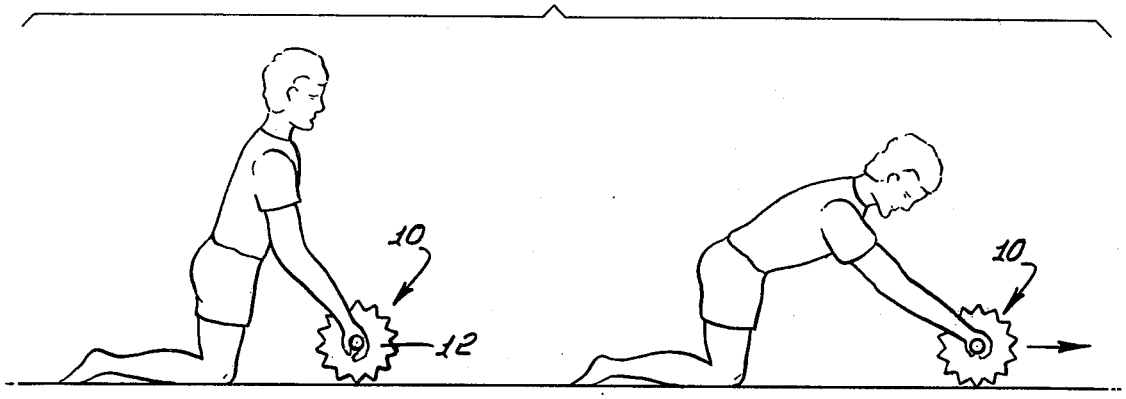
FIG. 4.
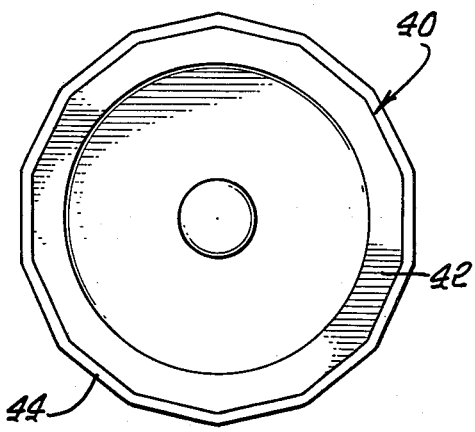
FIG. 5.
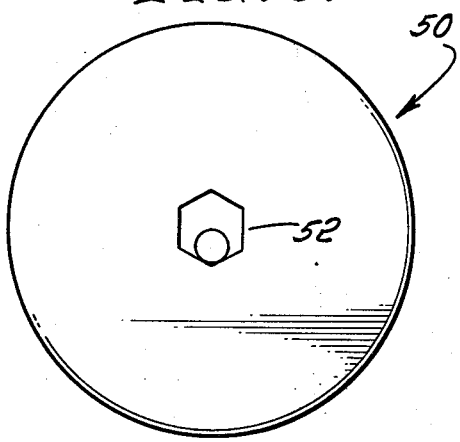
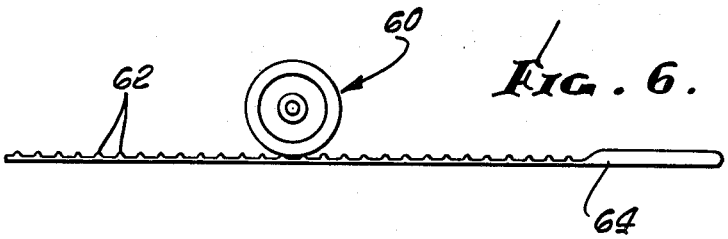
FIG. 6.
FIG. 7.
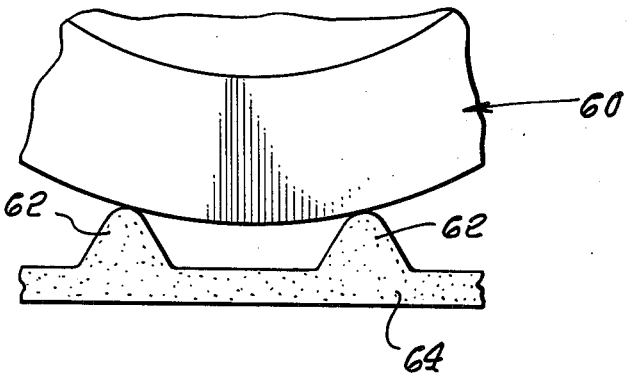

VIBRATING EXERCISING WHEEL

FIELD OF INVENTION

This invention relates to an isotonic exercising device, and particularly to an exercising wheel of the type commonly used for strengthening and toning and abdominal muscles and for trimming the waistline.

BACKGROUND OF THE INVENTION

Physical fitness is almost universally a recognized goal, but a significant effort and discipline are required by those that have no regular sports activities. Exercise wheels like many other devices are inexpensive and thus adaptable to home use whenever the user's schedule permits. The recommended exercises are repeated and monotonous. For this reason, the discipline of daily use is usually broken.

From prior experience, it is my opinion, supported by some medical schools of thought, that vibration imparted to the muscles during the course of alternate muscle stress and relaxation significantly increases blood flow. This is discussed in my prior USA Pat. No. 3,851,874 issued Dec. 3, 1974 and entitled PUSH-PULL TYPE EXERCISING DEVICE. The primary object of this invention is to provide an exercising wheel designed to impart vibrations to the user during the course of use so that beneficial blood flow is increased and so that pleasurable sensations are associated with the use of the exercising wheel whereby the discipline of regular use is more easily maintained.

SUMMARY OF INVENTION

In order to accomplish the foregoing objectives, I provide an exercising wheel that has a noncircular periphery preferably formed by a series of equiangularly spaced teeth or lobes. As the wheel periphery moves along the floor, the wheel axle moves up and down as the teeth move from one side to the other of the vertical plane passing through the wheel axis. In a modified form of the present invention, a smooth exercise wheel cooperates with a ribbed mat to achieve a similar up and down movement of the wheel axle.

BRIEF DESCRIPTION OF THE DRAWINGS

A detailed description of the invention will be made with reference to the accompanying drawings wherein like numerals designate corresponding parts in the several FIGURES. These drawings, unless described as diagrammatic or unless otherwise indicated, are to scale.

FIG. 1 is a two frame illustration showing the use of an exerciser wheel in a typical abdominal stretch exercise.

FIG. 4 and FIG. 5 are side elevational views showing modified forms of the present invention.

FIG. 6 is a side elevational view of a combination exerciser wheel and mat comprising another modified form of the present invention.

FIG. 7 is an enlarged fragmentary view of the mat and wheel shown in FIG. 6 showing the region of contact therebetween.

DETAILED DESCRIPTION OF PREFERRED EMBODIMENT

The following detailed description is of the best presently contemplated mode of carrying out the invention. This description is not to be taken in a limiting sense, but is made merely for purposes of illustrating the general principles of the invention since the scope of the invention is best defined by the appended claims.

Structural and operational characteristics attributed to forms of the invention first described shall also be attributed to forms later described, unless such characteristics are obviously inapplicable or unless specific exception is made.

FIG. 1 illustrates a typical use of a wheel exerciser 10. The exerciser 10 includes a wheel or rolling element 12 and an axle bar 14 projecting through the wheel, opposite ends of which are gripped by the user's hands. The exercise begins with the user in a kneeling position and the wheel exerciser just in front of the knees. The exerciser is wheeled forwardly and backwardly to a maximum comfortable extension while the stomach muscles are alternately tensed and relaxed. By exerting hand pressure inwardly and/or outwardly, chest region muscles are exercised. Various other uses are possible, such as leg extensions by pedal engagement.

Figure 3:
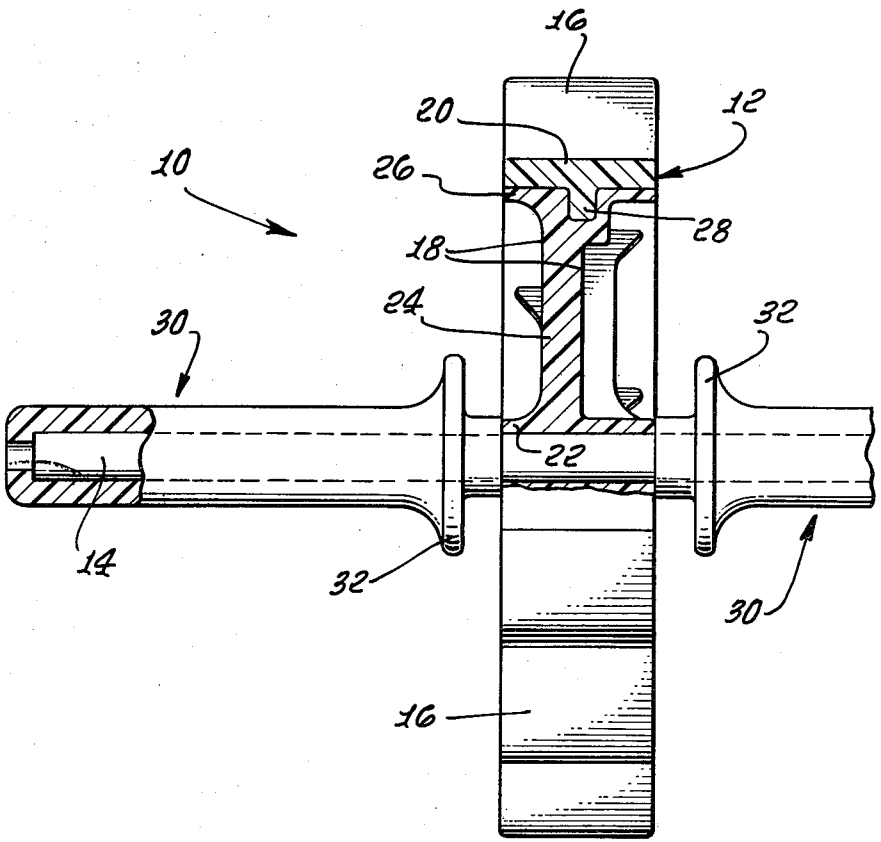
FIG. 3 is an axial sectional view of the exerciser wheel taken along a plane corresponding to line 3-3 of FIG. 2.

Movement of the wheel exerciser 10 imparts pleasant and stimulating vibrations to the user's body. This is achieved by the wheel 12 having a noncircular peripheral floor bearing surface in this instance provided by a series of protuberances in the form of equiangularly spaced teeth 16. The construction is shown more clearly in FIGS. 2 and 3.

The wheel 12 is of two part construction, a wheel body 18 and a wheel tread 20. The body 18 is preferably made as a plastic casting about eight inches in diameter having a central hub 22, a series of radiating spokes 24 and a rim 26. The rim 26 is itself angulated to form teeth. In the present instance, the angle between the sides of the teeth is about 60°. There are as many teeth as there are spokes, fourteen in the present example, each spoke terminating at a trough between the teeth. The tread 20 is fitted to the rim 26. The tread 20 preferably is made as a casting of resilient rubber-like material having at least some slight yielding or cushion characteristics. Suitable projections 28 (FIG. 3) can be provided to maintain the tread 20 centered on the rim of the wheel body.

The wheel axle bar 14 extends through the wheel hub 22 which serves as a journal bearing for the bar. The hub 22 is centered on the bar by the aid of hollow pads (pedals or grips) 30 telescoped over the ends of the bar. Thus, the inner ends of the pads oppose with slight clearance, the opposite ends of the hub 22. The pads 30 each have flanges 32 spaced slightly from their inner ends to allow flexure in response to inward pressure imposed during the course of certain manual exercises. The pads are made of suitable rubber-like material so that the flanges 32 have some slight spring characteristic.

As the wheel 10 is moved along the floor surface, as by pedal or manual engagement, the teeth move in succession into and out of load bearing relationship between the wheel and the floor. When a tooth crest is precisely aligned in the vertical plane passing through the wheel axle bar 14, the height of the axle bar relative to the floor surface is maximum. In this position, the wheel is unstable and, of course, quickly seeks the stable position in which the vertical plane is midway between adjacent tooth crests. As the wheel reaches this stable position, the succeeding tooth engages the floor, tending to decelerate the wheel. The height of the wheel axle reduces in accordance with the geometry of the segment as compared with a circle. The height reduction and the impact of the succeeding tooth produces a shock wave through the exerciser to the hands, arms and body of the user. Repeated shock waves resulting from continuous movement of the exerciser produces a vibration. The intensity of vibration depends upon the character of the tooth impact as affected by floor surface and tread material. The vibrations generated by the wheel must be more than a series of spaced shocks, which might result from too wide a spacing of the teeth. On the other hand, the vibrations must not reduce in intensity and increase in frequency to the point where vibrations are insignificant, which might result from too close a spacing of the teeth. There is, accordingly, a certain optimum range in the number of teeth or spacing.

Figure 2:
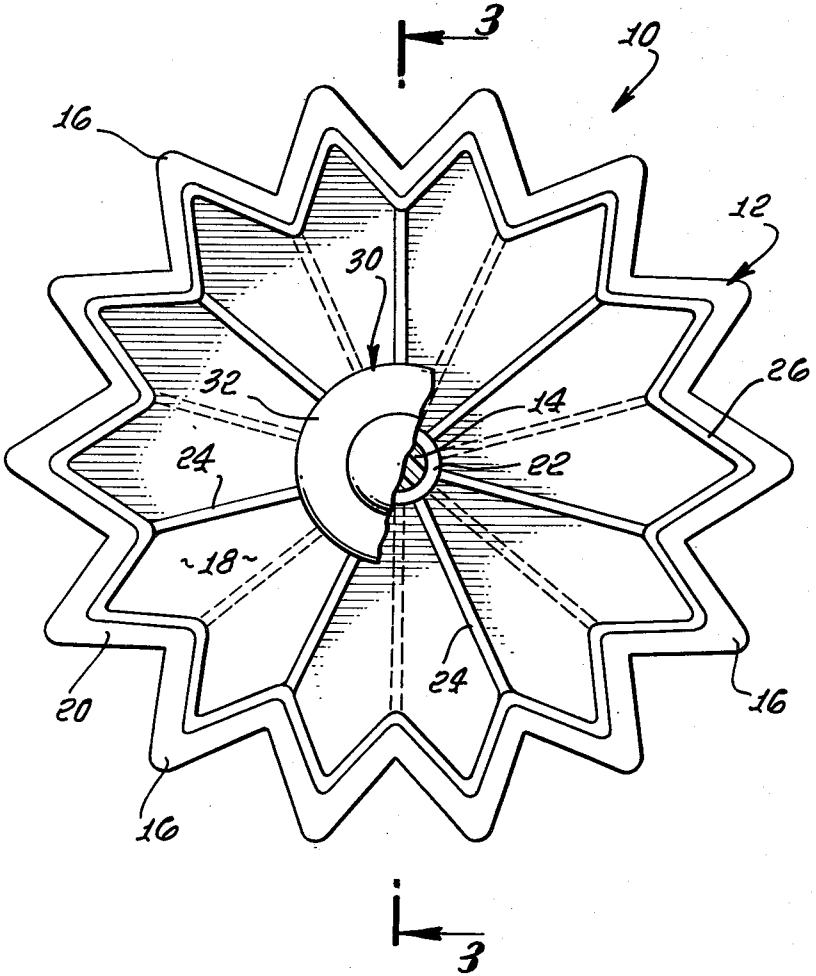
FIG. 2 is a side elevational view of an exerciser wheel incorporating the present invention.

One variable is wheel diameter. The wheel is desirably as small as possible while yet maintaining comfortable clearance between the user's hands or feet and the floor surface. Given this minimum diameter and a certain average velocity of movement of the wheel and with tooth structure designed as shown in FIG. 2, the optimum number of fourteen teeth produces stimulating vibrations on all floor surfaces.

DESCRIPTION OF ALTERNATE EMBODIMENTS

In the form illustrated in FIG. 4, the wheel exerciser has a wheel body 40 provided with a rim 42 and tread 44 formed to provide a near polygonal circumference. This exerciser will create vibrations similar to the previous exerciser only when used on a hard floor. It will not produce adequate vibrations when used on a carpet because it has no notched open areas between projections to receive the rub pile to minimize the cushioning effect.

In the form of the invention illustrated in FIG. 5, the exerciser wheel 50 has a circular peripheral floor bearing surface. However, the hub provides a noncircular over-sized bearing for the axle bar 52. The bearing has a generally polygonal shape. The axle bar as it is subject to a downward force component, seeks a rest position at the trough between successive sides of the polygonal bearing hub. At such position, the vertical height of the bar is minimum. As the bar is moved horizontally, the wheel rotates, causing the bar to move into successive troughs. The vertical movement, the snap action combine to produce a vibration.

In the form of the invention shown in FIGS. 6 and 7, the exerciser 60 again has a circular periphery and is itself of conventional form. However, it cooperates with teeth or ribs 62 of a floor member or mat 64. The exerciser moves up and down and receives shock loads upon movement past the spaced ribs. The spacing of the ribs and the texture of the materials determine the character of the vibrations produced.

Intending to claim all novel, useful and unobvious features shown or described, I make the following claims:

1. A wheel exerciser for use with a floor having a surface:

(a) a wheel body having an axis said wheel body having a series of protuberances forming a noncircular periphery each of said protuberances having an edge extending in a direction substantially parallel to said axis;

(b) a pair of pads on opposite sides of the wheel body;

(c) means connecting the pads to the center of the wheel body and permitting relative rotation between the wheel body and said pads said means being substantially rigid to prevent lateral deflection of said pads;

(d) each said protuberance being separated from the next protuberance by an opening, rotation of said wheel body by a user causing vibrations to be imposed upon said pads through said wheel body and through said rigid connecting means as said wheel body is moved along a floor surface or the like during an excercise program.

2. The wheel exerciser as set forth in claim 1 in which said protuberances are formed by angular teeth with angular troughs therebetween.

3. The wheel exerciser as set forth in claim 1 in which said wheel body has a rim, and a separate rubber-like resilient tread member mounted on the rim, said tread member providing the protuberances on said wheel body.

4. The wheel exerciser as set forth in claim 1 in which said protuberances are formed by angular teeth with angular troughs therebetween, there being approximately fourteen such teeth, the wheel diameter being just large enough to provide clearance between the hands of the operator and the floor.

5. The wheel exerciser as set forth in claim 1 in which said pads are grips having flanges attached thereto for relative rotation with the pads, said flanges resisting axial hand pressure, said flanges being made of resilient material flexed in response to such axial pressure.

6. In combination with a floor covering rug or carpet, a wheel exerciser comprising:

(a) a wheel body having an axis and a noncircular periphery provided by a series of protuberances, said protuberances providing alternate crests and troughs;

(b) a pair of pads located centrally of the wheel body and positioned on opposite sides of the wheel body;

(c) axle means connecting the pads to the wheel body, said axle means permitting relative rotation between the wheel body and said pads, said axle means being substantially rigid to prevent lateral deflection of the axle means;

(d) during rotation of said wheel body and protuberances when sucessively engaging the floor causing vibrations to be imposed upon said pads through said wheel body and through said axle means as said wheel body is moved along said floor covering rug or carpet, the crests and troughs being sized at least partially to receive the pile of the rug or carpet in said troughs whereby the cushioning effect of said rug or carpet is minimized and the imposition of vibrations maintained.

7. The combination as set forth in claim 6 in which said crests and troughs extend a substantial distance in a direction parallel to said wheel body, said crests and troughs both being angular.

* * * * *

UNITED STATES PATENT OFFICE

CERTIFICATE OF CORRECTION

Patent No. 4,136,867 Dated January 30, 1979

Inventor(s) DOUGLAS G. WILKIN

It is certified that error appears in the above-identified patent and that said Letters Patent are hereby corrected as shown below:

Column 1, line 7: Cancel "and" (second occurrence), and substitute --the--;

Column 3, line 42: Cancel "rub" and substitute --rug--;

Claim 1, line 3: Insert a comma (,) after "axis";

line 5: Insert a comma (,) after "periphery";

Signed and Sealed this

*Eleventh* Day of *March 1980*

[SEAL]

*Attest:*

SIDNEY A. DIAMOND

*Attesting Officer*

*Commissioner of Patents and Trademarks*